US010072844B2

(12) United States Patent
Kasimirski et al.

(10) Patent No.: US 10,072,844 B2
(45) Date of Patent: Sep. 11, 2018

(54) METHOD FOR THE PRODUCTION OF A GLOW PLUG

(71) Applicant: BorgWarner Ludwigsburg GmbH, Ludwigsburg (DE)

(72) Inventors: Hans Peter Kasimirski, Ludwigsburg (DE); Martin Allgaier, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 21 days.

(21) Appl. No.: 15/335,257

(22) Filed: Oct. 26, 2016

(65) Prior Publication Data

US 2017/0045225 A1 Feb. 16, 2017

Related U.S. Application Data

(62) Division of application No. 14/536,099, filed on Nov. 7, 2014, now Pat. No. 9,506,651.

(30) Foreign Application Priority Data

Nov. 20, 2013 (DE) ..... 10 2013 112 806

(51) Int. Cl.
*H05B 3/00* (2006.01)
*F23Q 7/00* (2006.01)

(52) U.S. Cl.
CPC ..... *F23Q 7/001* (2013.01); *F23Q 2007/004* (2013.01); *Y10T 29/49083* (2015.01)

(58) Field of Classification Search
CPC ..... Y10T 29/49083; H05B 3/48; F23Q 2007/004; F23Q 7/001
USPC ..... 29/611, 613, 619; 219/260, 267, 270, 219/544, 546
See application file for complete search history.

(56) References Cited

U.S. PATENT DOCUMENTS 6,144,015 A 11/2000 Chiu et al.
8,003,917 B2 * 8/2011 Kern ..... F23Q 7/001 219/260
8,471,180 B2 6/2013 Cheng et al.
2009/0321408 A1 12/2009 Kern et al.
(Continued)

FOREIGN PATENT DOCUMENTS

DE 699 32 685 T2 8/2007
DE 10 2008 009 429 A1 9/2008
(Continued)

*Primary Examiner* — Thiem Phan
(74) *Attorney, Agent, or Firm* — Bose McKinney & Evans LLP

(57) ABSTRACT

Methods for producing a glow plug having a housing, a ceramic glow pin and a protective tube from which a section of the glow pin projects which is thinner than a thicker section arranged in the protective tube. The thinner section leads to a glow tip. The glow pin is inserted into the protective tube and the protective tube is inserted into the housing. A securing element is placed onto the first end of the glow pin. The internal diameter of the securing element is smaller than the maximum diameter of the glow pin. The securing element is fastened on the protective tube. Alternatively, the protective tube is heated locally at a section of the protective tube surrounding the thinner section, and there the interior width of the protective tube is reduced to a value smaller than the diameter of the thicker section of the glow pin.

7 Claims, 4 Drawing Sheets

(56) References Cited

U.S. PATENT DOCUMENTS

| | | | |
|---|---|---|---|
| 2010/0224613 | A1 | 9/2010 | Haussner et al. |
| 2011/0215080 | A1 | 9/2011 | Hain et al. |
| 2012/0043309 | A1 | 2/2012 | Cheng et al. |

FOREIGN PATENT DOCUMENTS

| | | | |
|---|---|---|---|
| DE | 10 2009 056 057 | A | 6/2010 |
| DE | 10 2009 048 643 | A1 | 3/2011 |
| DE | 10 2009 011 415 | B4 | 9/2013 |
| EP | 1 239 222 | A2 | 9/2002 |
| JP | 2005-180855 | A | 7/2005 |

* cited by examiner

METHOD FOR THE PRODUCTION OF A GLOW PLUG

RELATED APPLICATIONS

This application is a divisional application of U.S. patent application Ser. No. 14/536,099, filed Nov. 7, 2014, which claims priority to DE 10 2013 112 806.8, filed Nov. 20, 2013, both of which are hereby incorporated herein by reference in their entireties.

BACKGROUND

The invention relates to a method for the production of a glow plug of the type having a housing, a ceramic glow pin and a protective tube from which a section of the glow pin projects, with said section leading to a glow tip and being thinner than a thicker section arranged in the protective tube. Such glow plugs are generally known from DE 10 2009 048 643 A1.

Ceramic glow pins are fragile. Glow plugs with ceramic glow pins therefore usually have a protective tube in which the glow pin is placed. Such a protective tube can protect the glow pin from damage over the majority of its length and thus reduce the risk of a glow pin breaking. In order to prevent a piece of the glow pin from falling into the combustion chamber of an engine in the case of a glow pin breakage, it is known from DE 10 2009 048 643 A1 to crimp and thus constrict the protective tube at its front end after placing onto the glow pin. This protective tube surrounds a glow pin, the diameter of which increases behind the crimped end region of the protective tube. If the glow pin breaks in the protective tube, a falling out of a broken glow pin piece can thus be prevented.

The glow pin diameter inside the protective tube can change only by some tenths of a millimeter. This is a problem because the glow pin must not be stressed while the protective tube is compressed. Moreover, by compressing, the protective tube is deformed not only plastically but also to some extent elastically. The elastic deformation is not maintained, so that the protective tube re-expands after compressing. It is therefore hard to ensure that the protective tube remains constricted at its end to such an extent that the glow pin is secured in the protective tube.

From EP 1 239 222 A2 it is known to solder the glow pin into the protective tube and to thus secure it from falling out. A problem here is that during the cooling of the solder, tensions occur which can lead to crack formation in the glow pin.

SUMMARY

This disclosure teaches a way to reduce the risk of damage to the glow pin during the production of a glow plug, in the protective tube of which a broken off piece of a glow pin is reliably kept from falling out in the case of a breakage of the glow pin.

In an exemplary embodiment, instead of deforming the protective tube, a securing element is slipped onto the glow pin and fastened to the protective tube. The securing element has a smaller internal diameter than the protective tube and thus constricts the free inner diameter of the tube. As a consequence, a section of the glow pin surrounded by the protective tube no longer fits through the protective tube. When the glow pin breaks in the protective tube, the glow pin or respectively the broken off piece of the glow pin cannot fall out, but rather is held by the securing element.

The securing element therefore has an internal diameter which is smaller than the maximum diameter of the glow pin.

The securing element can be fastened to the protective tube for example by welding or soldering. It is particularly advantageous to fasten the securing element on the protective tube by press fitting. When the protective tube is also fastened to the housing by press fitting, both interference fits can be created in one working step. Alternatively, the protective tube can also be connected with the housing by soldering or welding.

The securing element can be a ring or a sleeve, for example.

The securing element can be manufactured with little expenditure as a metal part with close tolerances, so that even a small increase in diameter, for example 0.1 mm to 0.5 mm of the glow pin is sufficient in order to secure it reliably from falling out. The increase in diameter of the glow pin can be configured for example as a step. The internal diameter of the securing element then lies between the diameter of the glow pin in front of and behind the step. As an alternative to a step, the diameter of the glow pin can also increase continuously, for example conically.

In one embodiment taught herein, a separate securing element can be dispensed with. The protective tube is heated locally at least one site, which lies between the glow tip and a thicker section of the glow pin arranged in the protective tube, and at this site the interior width of the protective tube is reduced to a value which is smaller than the diameter of the thicker section of the glow pin.

By local heating of the protective tube, the glow pin is not appreciably stressed. The protective tube can be easily deformed at the heated site or the heated sites, and its interior width can thus be reduced. The protective tube can be heated locally to such an extent that it melts at the heated site(s) and can therefore be deformed particularly easily.

The protective tube can be heated in a ring-shaped section which is then shaped to an inwardly directed bead. However, it is sufficient to heat the protective tube at a single site, which extends only along a portion of the circumference, and to produce an inwardly directed projection at this site. This is already sufficient in order to reduce the interior width of the protective tube to an extent such that the glow pin is secured in the protective tube. Preferably, the protective tube is heated locally at several sites which are spaced apart from one another in a circumferential direction. Thus, for example, two, three or more projections can be produced, arranged in a ring shape, which bring about an excellent securing of a glow pin arranged in the protective tube.

The protective tube can be heated locally for example with a laser beam. Alternatively, the protective tube can also be heated locally inductively.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
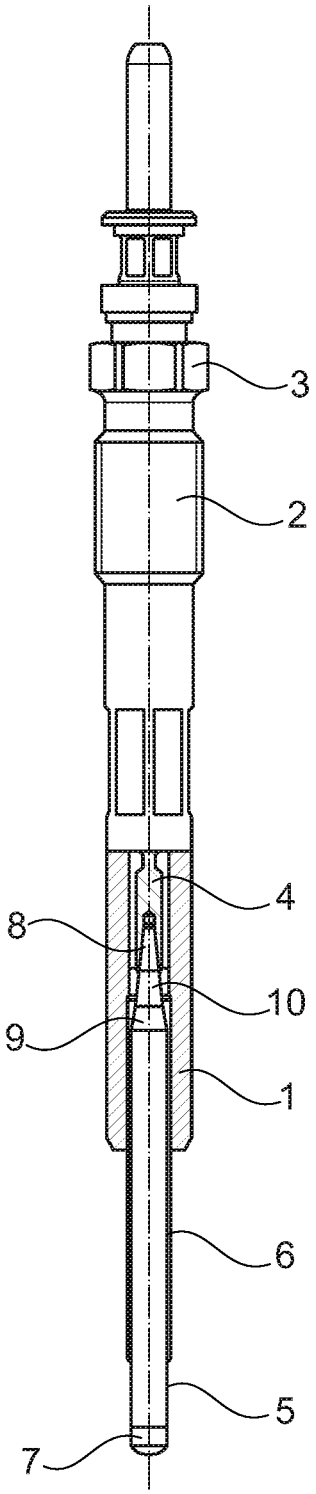
FIG. 1 shows a glow plug in a partially sectional view.

In FIG. 1 an embodiment is shown schematically in a view partially in section. The glow plug has a metallic housing 1, which can have an external thread 2 and a hexagon 3. In the housing 1, an inner conductor 4 is arranged, which is connected to the rear end, remote from the combustion chamber, of a ceramic glow pin 5. The glow pin 5 is surrounded by a protective tube 6, from which it projects by its two ends, and has at its front end a glow tip 7. At its rear end, the glow pin 5 has a narrowing section, which can be partially surrounded by the protective tube 6.

The ceramic glow pin 5 can have, for example, an inner conductor 8, an outer conductor 9 and an insulator layer 10 lying therebetween. Such a glow pin 5 can be connected to the inner conductor 4, by the rear end of the glow pin 5 being placed in the inner conductor 4.

Between its two ends, the glow pin has a cylindrical section, which may form the largest part of the length of the glow pin 5, but may also be shorter. Between the cylindrical section and the glow tip 7, the diameter of the glow pin 5 decreases inside the protective tube 6, for example in a stepped manner or in a conical section. The cylindrical section is therefore thicker than a section projecting out from the front end of the protective tube 6. This decrease in diameter enables a securing of the glow pin 5, so that the latter can not fall out from the protective tube 6 even in the case of a breakage of the glow pin.

Figure 2:
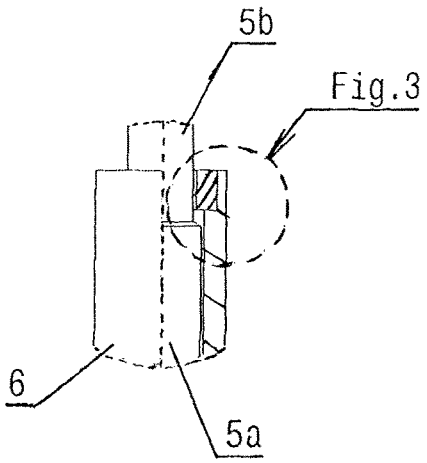
FIG. 2 shows a detail view to FIG. 1.
Figure 3:
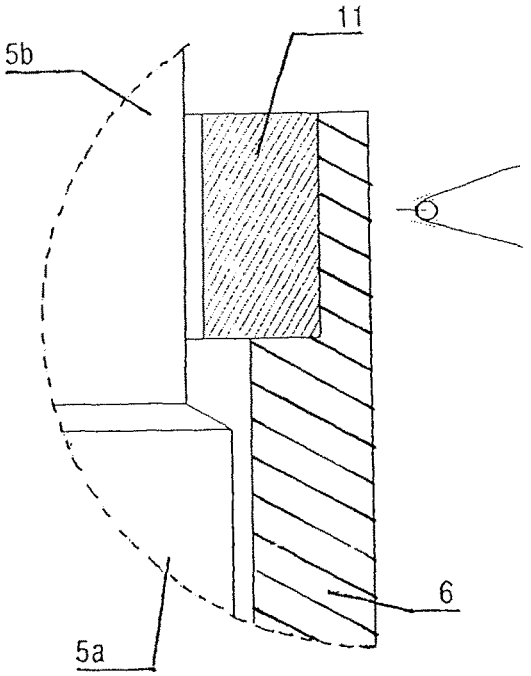
FIG. 3 shows a detail view to FIG. 2.

FIG. 2 shows a detail view of the front end of the protective tube 6 on the combustion chamber side, in which a cylindrical section 5*a* of the glow pin is arranged. Adjoining this section 5*a* is a thinner, preferably likewise cylindrical, section 5*b* of the glow pin. Between the two sections 5*a*, 5*b* there is a step or a transition section, which may be conical, for example. FIG. 3 shows an enlarged detail view to FIG. 2. In FIG. 3, the front end of the protective tube 6 and a securing element 11 fastened thereon are illustrated. The securing element 11 has a smaller internal diameter than the protective tube 6. The internal diameter of the securing element 11 is smaller than the maximum diameter of the glow pin 5, i.e., smaller than the diameter of the cylindrical section 5*a*.

In an end section, the protective tube 6 has an increased internal diameter, and thus forms a mount for the securing element 11. In this end section, the protective tube 6 can have a reduced wall thickness. In the embodiment of FIGS. 2 and 3, the securing element 11 is a ring. This ring can be arranged entirely inside the protective tube 6 or can project out from the protective tube 6.

Figure 4:
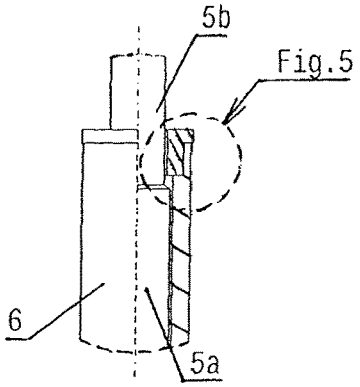
FIG. 4 shows a detail view according to FIG. 2 of a further embodiment.
Figure 5:
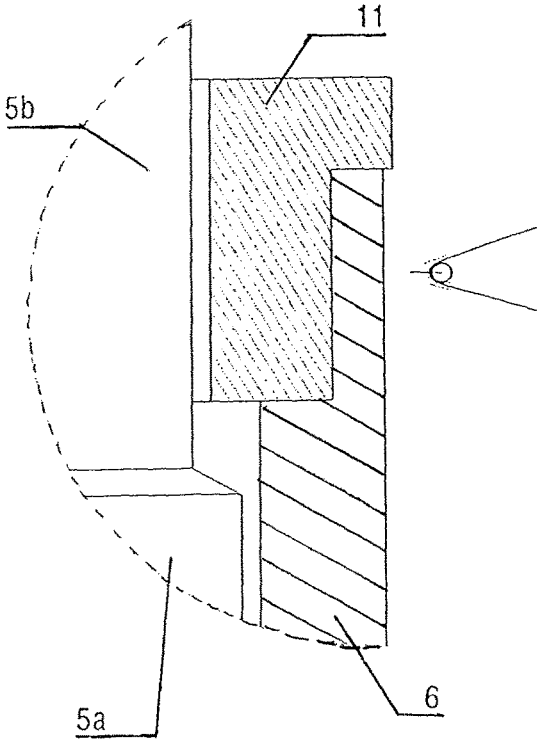
FIG. 5 shows a detail view to FIG. 4.

In FIG. 4 and the associated detail view of FIG. 5, a modified embodiment is illustrated, which differs from the example of FIGS. 2 and 3 only in the configuration of the securing element 11. The securing element 11 of FIGS. 4 and 5 projects from the protective tube 6 and has an increased external diameter outside the protective tube 6. The securing element 11 sits with a first section on the protective tube 6 and with a second, thinner section in the protective tube 6.

The securing element 11 can be fastened to the protective tube 6 by press joining, for example can be pressed into the protective tube after the glow pin 5 has been inserted into the protective tube 6. The protective tube 6 can be fastened to the housing 1 by press fitting. Both pressing-in processes can be carried out in one working step.

Figure 6:
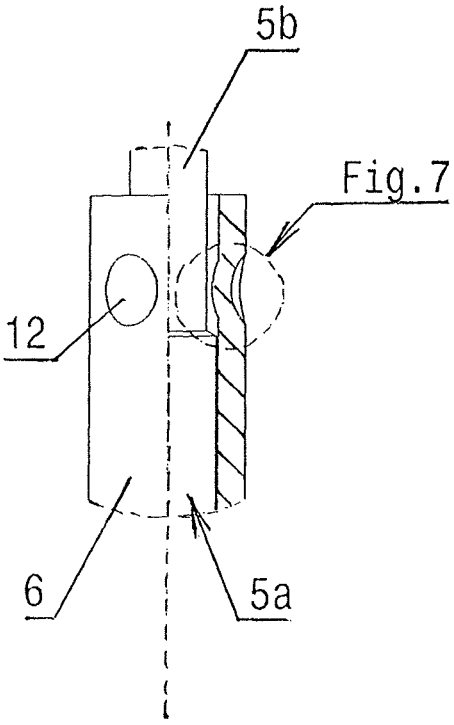
FIG. 6 shows a detail view according to FIG. 2 of a further embodiment.

FIG. 6 shows a detail view of an embodiment of a glow plug without a securing element. In FIG. 6, the front end of the protective tube 6 is illustrated together with the thicker section 5*a* and the thinner section 5*b* of the glow pin. In this example embodiment, a securing of the glow pin in the protective tube 6 was achieved in that the protective tube 6 is heated locally at least one site 12 which lies between the glow tip 7 and the thicker section 5*a* arranged in the protective tube 6, and the interior width of the protective tube 6 is reduced there to a value which is smaller than the diameter of the thicker section 5*a* of the glow pin. The protective tube 6 was heated locally at several sites 12 and pressed in there, so that radially inwardly directed protuberances, for example three protuberances, are produced. These sites 12 lie in a section of the protective tube 6 which surrounds the thinner section 5*b* of the glow pin.

Figure 7:
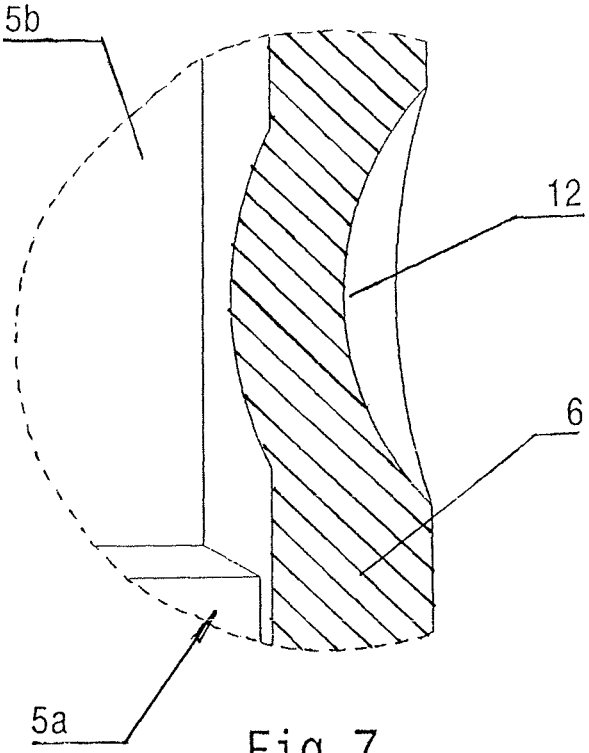
FIG. 7 shows a detail view to FIG. 6.

FIG. 7 shows a detail view to FIG. 6, in which one of the deformed sites 12 of the protective tube 6 is illustrated. The protective tube 6 can be fused at the sites 12, for example by a laser beam. The sites 12 can be arranged in a ring shape.

Figure 8:
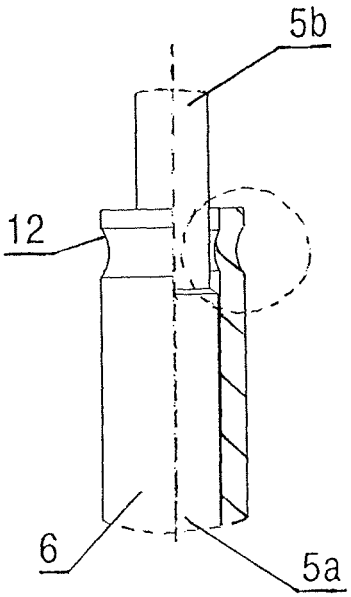
FIG. 8 shows a detail view according to FIG. 2 of a further embodiment.

In FIG. 8, a modified embodiment is illustrated, in which the protective tube is heated locally at a ring-shaped site 12 and there the interior width of the protective tube 6 is reduced to a value which is smaller than the diameter of the thicker section 5*a* of the glow pin. The ring-shaped site 12 can be heated for example inductively or by radiation and forms an inwardly directed bead.

Figure 9:
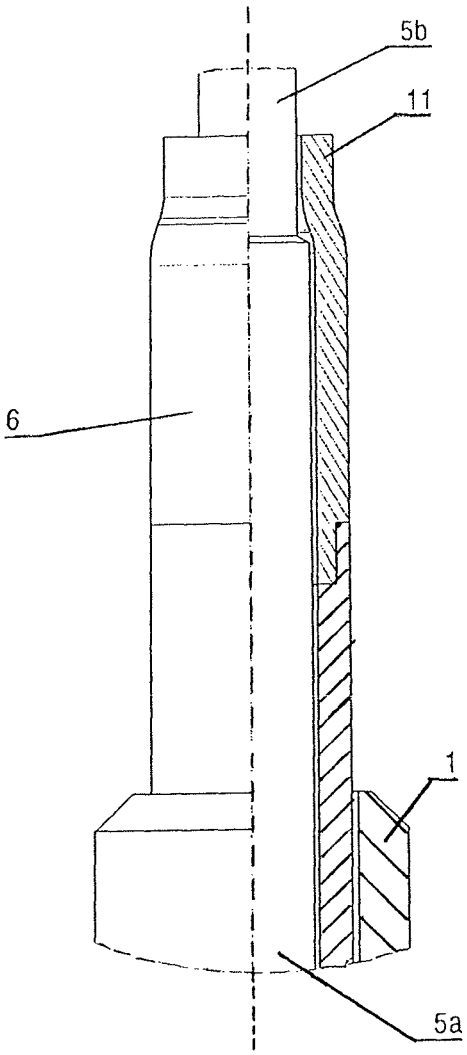
FIG. 9 shows a detail view according to FIG. 2 of a further embodiment.

FIG. 9 shows a detail view of a further embodiment of a glow plug with a securing element 11, which is constructed as a sleeve.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE NUMERALS

1 housing
2 external thread
3 hexagon
4 inner conductor
5 glow pin
5*a* thicker glow pin section
5*b* thinner glow pin section
6 protective tube
7 glow tip
8 inner conductor of the glow pin
9 outer conductor of the glow pin
10 insulator layer of the glow pin
11 securing element
12 deformed site of the protective tube

What is claimed is:

1. A method for manufacturing a glow plug having a housing, a ceramic glow pin and a protective tube from which a section of the glow pin projects, said section leading to a glow tip and being thinner than a thicker section arranged in the protective tube, the method comprising:

inserting the glow pin into the protective tube and inserting the protective tube into the housing;

placing a securing element onto the first end of the glow pin and into an increased internal diameter section of the protective tube, the internal diameter of the securing element being smaller than the maximum diameter of the glow pin; and fastening the securing element onto the protective tube.

2. The method according to claim 1, wherein the glow pin has a diameter that increases in a step and wherein the internal diameter of the securing element is between the diameter of the glow pin in front of the step and the diameter of the glow pin behind the step.

3. The method according to claim 1, wherein the securing element is fastened to the protective tube by an interference fit.

4. The method according to claim 1, wherein the protective tube is fastened to the housing by an interference fit.

5. The method according to claim 1, wherein the securing element is a ring or a sleeve.

6. The method according to claim 1, wherein the securing element is arranged entirely outside the housing.

7. The method according to claim 1, wherein the glow pin has a narrowing section at its end facing away from the glow tip, and in that the glow pin is pressed into a protective tube which narrows at its end arranged in the housing and surrounds there a portion of the narrowing section of the glow pin.

* * * * *